US005464065A

United States Patent [19]

Kaylor

[11] Patent Number: 5,464,065

[45] Date of Patent: Nov. 7, 1995

[54] METHOD FOR EXTINGUISHING TANK FIRES

[75] Inventor: Joseph B. Kaylor, Manassas, Va.

[73] Assignee: Valkyrie Scientific Proprietary, L.C., Reston, Va.

[21] Appl. No.: 199,645

[22] Filed: Feb. 22, 1994

Related U.S. Application Data

[63] Continuation-in-part of Ser. No. 21,014, Feb. 22, 1993, Pat. No. 5,377,765.

[51] Int. Cl.[6] ..... A62C 3/06

[52] U.S. Cl. ..... 169/44; 169/66; 169/68; 169/46; 169/15

[58] Field of Search ..... 169/66, 68, 44, 169/46, 15

[56] References Cited

U.S. PATENT DOCUMENTS

| | | | |
|---|---|---|---|
| 307,689 | 11/1884 | Thayer | 169/66 |
| 1,115,887 | 11/1914 | Bartels | 169/66 |
| 1,164,234 | 12/1915 | Steiner et al. | 169/46 |
| 2,718,927 | 9/1955 | Dill et al. | 169/68 |
| 2,730,178 | 1/1956 | Risinger | 169/46 |
| 3,475,333 | 10/1969 | Meldrum et al. | 169/66 |
| 4,664,199 | 5/1987 | Grant et al. | 169/68 |
| 5,113,945 | 5/1992 | Cable | 169/15 |

FOREIGN PATENT DOCUMENTS

| | | | |
|---|---|---|---|
| 3620574 | 12/1987 | Germany | 169/15 |
| 1299599 | 3/1987 | U.S.S.R. | 169/66 |
| 1337107 | 9/1987 | U.S.S.R. | 169/66 |
| 1553145 | 3/1990 | U.S.S.R. | 169/66 |
| 1634287 | 3/1991 | U.S.S.R. | 169/66 |
| 568811 | 4/1945 | United Kingdom | 169/66 |

*Primary Examiner*—David M. Mitchell
*Assistant Examiner*—Gary C. Hoge
*Attorney, Agent, or Firm*—Roland H. Shubert

[57] ABSTRACT

Fires in tanks storing combustible liquids are extinguished using water from a settled layer at the tank bottom to form a foam that is transported to the top of the combustible liquid by the lifting action of an inert gas stream introduced into the tank at a location below the liquid surface. A stream of water is removed from the tank, mixed with a foam-forming concentrate, merged with a flowing stream of inert gas, and circulated back to the tank at a point below the surface of the stored liquid to form an upwelling foam column which explodes upon the liquid surface and spreads across that surface to extinguish the fire and prevent its reignition.

11 Claims, 2 Drawing Sheets

METHOD FOR EXTINGUISHING TANK FIRES

This application is a continuation-in-part of U.S. patent application Ser. No. 08/021,014 which was filed on Feb. 22, 1993, now U.S. Pat. No. 5,377,765, for a "Method and Means for Extinguishing Tank Fires."

TECHNICAL FIELD

This invention relates to systems and techniques for extinguishing fires of flammable liquids and gases stored in tanks and other confined spaces.

More particularly, this invention relates to the extinguishment of fires in confined spaces aboard tankers and in large, above ground storage tanks for crude oil, refined products and other flammable liquids and gases by providing methods and means for the creation and placement of inert gases and a fire extinguishing foam on the surface of the burning liquid.

BACKGROUND ART

The state of the art is well summarized in a report prepared by Henry Persson and entitled "Design, Equipment and Choice of Tactics are Critical When Fighting Large Tank and Bund Fires." That report is further identified as Brandforsk Project: 612–902; Swedish National Testing and Research Institute, Fire Engineering, SP Report 1992:02. The purpose of that report was to develop knowhow based on the experience and recommendations of fire experts to provide a practical basis for the design and planning of foam extinguishing systems for large tank and bund fires. A bund fire is one within the embankment or dike surrounding a storage tank.

A traditional approach to the fighting of such fires has been to direct streams of water and foam onto the fire site through monitors or even hand-held nozzles. In order to successfully extinguish large fires using traditional techniques it is necessary to have available an adequate supply of water and foam concentrate to allow the application of foam liquid at a minimum rate of 6.5 $l/m^2/min$ to the burning surface for some 60 to 90 minutes. The report indicates agreement among the experts that concentrating foam application on as small an area in the tank as possible is far superior to the previously accepted technique of fighting tank fires with several small monitors distributed around the circumference of the tank. Concentrating the foam application at one point more quickly establishes a bridge head, or initial foam cover, thus increasing the effectiveness of subsequently applied foam.

Among other findings of the report are that no successful fire extinguishing operation has been verified in tanks over about 45 m in diameter. Indeed, some experts hold that a tank of 45 m in diameter represents about the largest that can be extinguished with mobile equipment. It appears to be the general consensus of the experts that tanks up to at least 60 m in diameter can be extinguished if the tanks are equipped with fixed "over-top" systems to apply foam. It is considered possible as well to extinguish fires in even larger tanks if the over-top system is supplemented with a bottom feed system.

A fixed, over-top system comprises permanently installed piping and foam sprinkler nozzles within the tank itself at a level above the liquid surface when the tank is filled to capacity. A bottom feed system employs a hose array with foam deploying nozzles adapted to float on the surface of the stored liquid and to rise and fall with the liquid as the tank is filled and emptied. Both systems require connection to a water source and to a supply of foam concentrate. That connection may be a permanent one through a direct attachment to the water mains and to a store of foam but the systems are more commonly supplied from a mobile unit which is connected to a system through hoses at the time of need. Both systems are difficult to maintain and are essentially impossible to test without contamination of the tank contents.

Subsurface foam injection systems for fighting tank fires are also known. Those systems inject foam through a port in a tank wall under sufficient pressure to overcome the pressure of the head of gasoline or other flammable liquid stored in the tank. Foam then rises through the liquid in the tank and spreads on the liquid surface to extinguish the fire. Production of the foam is accomplished using a high back pressure foam-maker. Such foam-makers operate by using a venturi to aspirate air into a foam solution at a carefully selected ratio of air-to-solution ranging from 2:1 to 4:1. High back pressure foam-makers usually operate at inlet pressures of 100 to 300 psi against back pressures (the sum of the tank fluid head pressure and the piping friction losses between the foam-maker and the tank) of up to about 40% of the inlet pressure.

Application rate, or injection rate, of the foam solution is governed by the tank surface area. That application rate is typically set at about 4 $lpm/m^2$ and seldom exceeds twice that rate. Thus, for a tank 50 m in diameter, the foam solution injection rate would be some 7850 lpm. The quantity of foam solution required is dependent upon the vapor pressure, or flash point, of the flammable liquid stored in the tank. A liquid with a high flash point, lubricating oil for example, would typically require foam injection for about a half hour while a volatile fuel such as gasoline requires a foam injection time of about twice that. Thus, the volume of foam solution required to extinguish a fire in a gasoline tank amounts to nearly a foot of tank depth.

Foam concentrates used with subsurface injection systems must be either a fluoroprotein or an AFFF type. Other foam types absorb hydrocarbon vapor as the foam rises through a fuel column and will burn as the foam reaches the surface. Conventional subsurface foam injection systems can be used only with hydrocarbons and not with polar liquids. Polar liquids tend to dissolve fluoroprotein or AFFF foam concentrates causing water to drain from the foam bubbles and leaving only the aspirated air to rise to the liquid surface. For that same reason, foam produced using a high back pressure foam maker cannot be discharged into the layer of water typically found in the bottom of hydrocarbon storage tanks.

Fires aboard tankers carrying either crude oil or refined petroleum products pose many of the same problems as do fires in stationary tanks. Consequently, tanker fires have been traditionally fought using much the same tactics used in the fighting of stationary tank fires. However, the difficulties of access and of the coordination of equipment, personnel and decision-making are ordinarily vastly greater in a tanker fire than those encountered at land locations.

Fires in tankers and stationary storage tanks, while relatively uncommon, pose enormous risks. Those risks include the threat of injury or death to people aboard the ship or in the area or engaged in fighting the fire, the likelihood of huge property losses, and the nearly certain contamination of soils, beaches, ground and surface water and air. Further, the intense thermal radiation always threatens to ignite adjacent structures and tanks thus compounding the risks and increasing the potential losses.

With this background, it can readily be appreciated that fire fighting tactics and systems which can more quickly and surely bring under control and extinguish fires in confined spaces in structures, aboard tankers and in tanks, particularly those fires in large stationary or mobile tanks, is of great environmental and economic importance.

DISCLOSURE OF THE INVENTION

This invention provides devices and techniques for establishing a foam cover on the surface of a burning liquid contained in a tank or other confined space to thereby control and extinguish the fire and prevent its re-ignition and burn-back. A flow of an inert gas is first established into the tank at an entry point below the surface of the flammable-liquid contained therein and a water layer is established at the bottom of the tank below the flammable liquid. A stream of water is then taken from the interior of the tank at an exit point lower in elevation and spaced apart from the gas entry and adjacent the bottom of the tank and is merged with the gas. That combined stream, powered by the flowing gas, is circulated back into the tank through the gas entry point. A foam concentrate, which may be either a liquid or a powder, is added to the flowing fluid steam to form droplets of foam solution and foam bubbles in the flowing gas entering the tank. Gas rising through the liquid in the tank forms an expanding cone which carries droplets of foam solution and foam bubbles to the surface of the burning liquid where the inert gas escapes and tends to snuff the flame while the foam forms a rapidly spreading layer atop the liquid surface to extinguish the fire and prevent its burn-back.

Hence, it is an object of this invention to provide improved methods for fighting and extinguishing fires in petroleum tankers and storage facilities.

Another object of this invention is to provide improved means and apparatus for establishing an extinguishing foam layer on the surface of a burning liquid contained in a storage tank.

Yet another object of this invention to provide improved methods and techniques for extinguishing fires of flammable liquids contained in storage tanks.

Other objects will be apparent from the following description of exemplary embodiments and techniques.

DESCRIPTION OF THE DRAWING

Specific embodiments of the invention are illustrated in the drawing in which.

MODES FOR CARRYING OUT THE INVENTION

Figure 1:
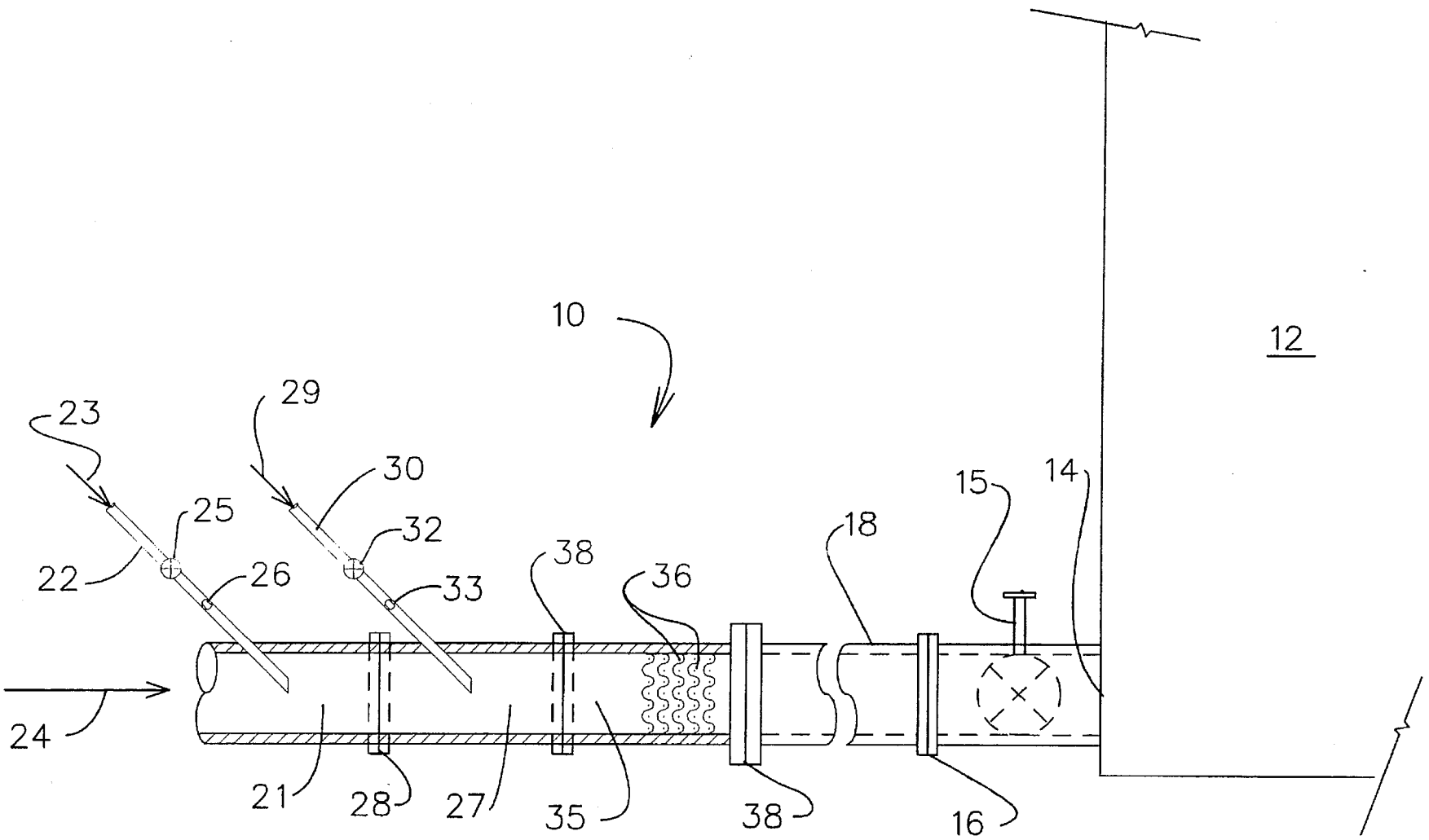
FIG. 1 is a partial sectional view of apparatus for the injection of foam-forming constituents into a liquid-filled tank.
Figure 2:
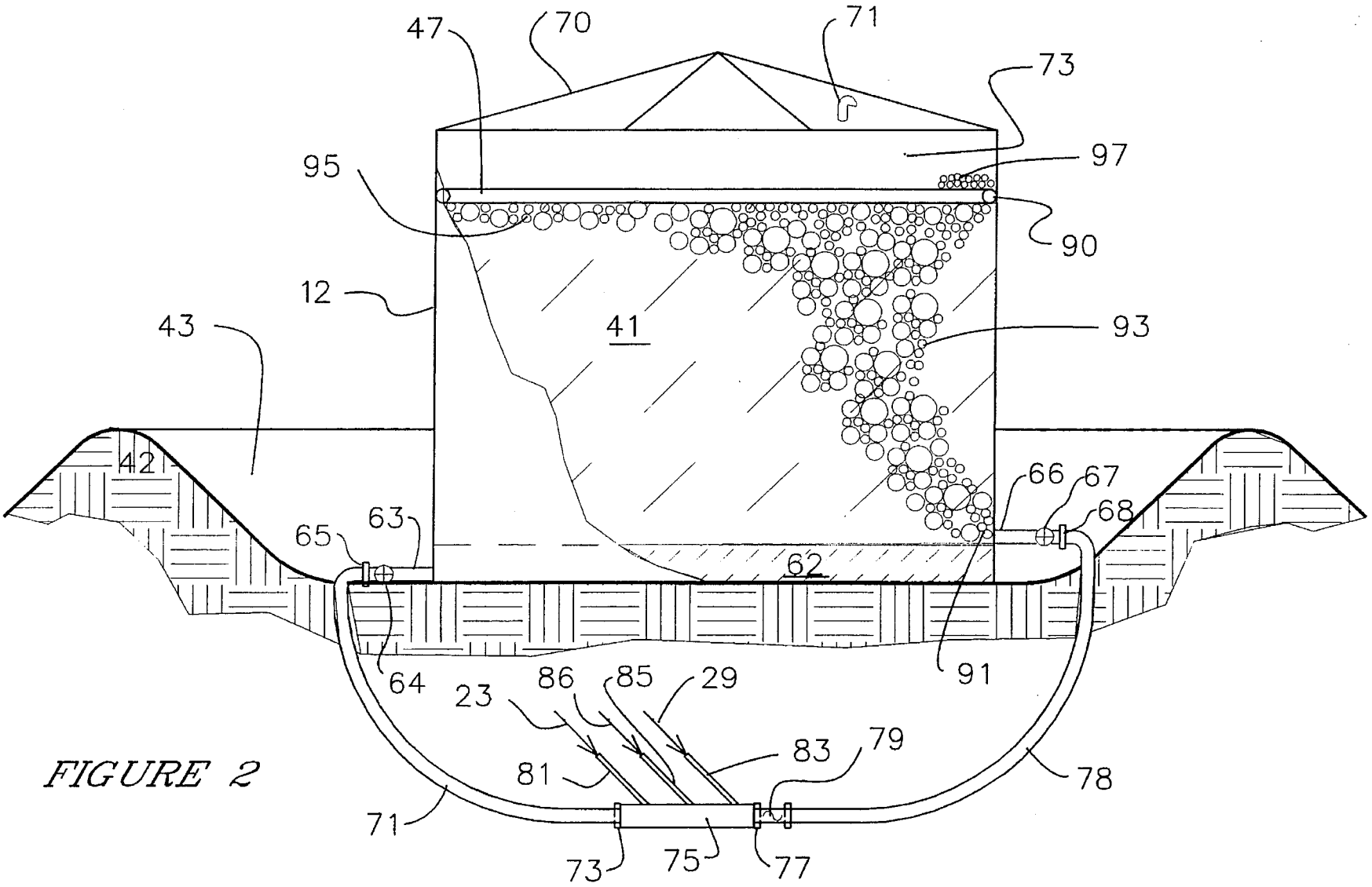
FIG. 2 is a schematic view in partial section illustrating a preferred embodiment of this invention.

Various embodiments of this invention will be described and discussed in detail with references to the drawing figures. Turning first to FIG. 1, there is shown a device 10 adapted to mix foam components and to inject them into a liquid-filled tank 12. Tank 12 may be a large, fixed, above-ground tank such as those conventionally used for the storage of crude oil and refined petroleum products or it may comprise a mobile tank such as, for example, a compartment of a tanker vessel. In the event that tank 12 is an above-ground storage tank, it ordinarily would be spaced apart from adjacent tanks or other structures and usually would be surrounded by a dike 42 (FIG. 2). Dike 42 forms a basin 43 sized so as to contain the contents of tank 12 in the event of spills or tank rupture.

Tank 12, whether it be fixed or mobile, ordinarily will be equipped with one or more ports 14 extending through the tank wall to provide means for fluid communication between the interior and exterior of the tank. In a fixed tank, port 14 generally terminates at a flange 16 which is adapted for connection to a hose, pipe or other conduit means and includes a valve 15 to control the flow of fluid into and out of the tank. In a mobile tank, such as a compartment within a tanker, port 14 may connect to the system of pumps and piping for the loading and discharge of cargo or for the transfer of liquid from one tank compartment to another.

In either event, injection means 10 connects to port 14 by way of hose or other conduit means 18 through connector flange 16. Means 10 itself includes three distinct zones serially arranged within a conduit. The first zone 21 functions to introduce a metered stream of gas or gas forming liquid from source 23 into injection means 10. Gas entry is by way of gas introduction means 22 having associated therewith valve means 25 which function to start and stop flow and to prevent backflow from zone 21. The rate at which gas or gas forming liquid is introduced into zone 21 may be controlled by way of flow limiting orifice 26. Generally speaking, the rate of gas introduction will be sufficient to provide a gas volume, measured at ambient temperature and pressure, which is at least about equal to the volume of liquid flowing through the zone and preferably many times that volume. In all events, the rate of gas introduction must be sufficient to form foam bubbles by interaction with the solution of foam concentrate and water and to lift liquid droplets and foam bubbles up through the flammable liquid to the surface.

Second zone 27 comprises means 30 for the metered addition of a foam concentrate from source 29 to a flowing stream of water from supply 24. Foam addition means 30 is provided with valve assembly 32 which serves to both start and stop the flow of foam concentrate into the stream of water flowing through means 10 and to prevent backflow from zone 27. The flow rate of foam concentrate through means 30 may be controlled by means of orifice 33 or through use of an upstream metering pump (not shown) so as to obtain a desired ratio of foam concentrate to water in zone 27. That desired ratio will ordinarily be set so as to obtain a final foam concentration ranging from about 0.01% to 10% but preferably within the range of about 0.5% to 6%.

The first zone 21 and the second zone 27 can be serially arranged in either order. However, it is been found that better results are obtained by introducing the gas upstream of the foam concentrate and that arrangement is preferred. In either case, fluids leaving the second zone comprise two phases, one liquid and the other gas, which can tend to separate and to travel along the conduit in slugs. Just downstream of the second zone there is provided a third zone 35 which acts to admix the two phases and to disperse gas throughout the mass of the flowing liquid. Mixing zone 35 utilizes a motionless mixer or other gas-liquid contacting device 36 to obtain an intimate dispersion of one phase in the other. The mixed fluids are then passed through port 14 into the flammable liquid contained in tank 12. In certain instances, especially when a gas forming liquid is introduced into zone 27, a sufficient degree of gas-liquid dispersion may be obtained in third zone 35 without use of mechanical mixing elements.

First zone 21 may be close coupled to second zone 27 by way of connector means 28 as is shown in the drawing or it may be separated therefrom by an extended length of hose or piping so long as the serial relationship of the first to the second zone is maintained. Mixing zone 35, however, is preferably adjacent to and just downstream of second zone 27 so as to minimize the segregation of gas and liquid into slugs. Coupling means 38 may be utilized to join zones 27 and 35 or those zones may be constructed as a unitary mechanism.

A fire in tank 12, if allowed to progress for any extended period of time, will often involve essentially the whole top surface of the tank in the fire. Fighting such a tank fire in accordance with this embodiment of the invention is carried out in the following manner. A flow of gas from supply 23 is established through injection means 10 and port 14 into the interior of tank 12. The pressure and kinetic energy of the gas entering the tank at port 14 must be sufficient to overcome the pressure head of liquid contained in tank 12 as well as to ensure flow at the required rate. Typical storage tanks may be 15 to 25 m in height so expected pressure heads are in the range of 1 to 2 bars.

After the gas flow has been established, a flow of water from source 24 into the injection means 10 is started. It is preferred that the pressure of water in source 24 be about equal to the pressure head of liquid contained in the tank but the pressure need not be higher than that. Energy from the flowing, expanding gas serves to carry the water with it. Introduction of foam concentrate 29 into means 10 is then begun. The admixture of gas, water and foam concentrate produces gas filled foam bubbles and liquid droplets which will be lifted with the expanding gas through the liquid column to the top of the flammable liquid contained in the tank. The resulting foam blanket will float on hydrocarbons and extinguish fire.

In conventional practice, foam for subsurface injection is produced using a high back pressure foam-maker which aspirates air into a solution of water and foam concentrate flowing at high pressure and velocity. The use of air as the bubble forming agent brings with it some severe disadvantages in that air supports combustion and has only a slight solubility in water. In contrast to conventional practice, the process of this invention uses inert gases, particularly carbon dioxide, nitrogen and mixtures of the two, as the bubble forming agents to create the fire extinguishing foams used herein. The use of carbon dioxide as the bubble forming agent offers special advantages because of the solubility of the gas in water. Other inert gases including, for example, argon, oxygen depleted flue gases and the like, may also find use but those are less preferred.

The pressure and kinetic energy of the gas or liquid from source 29 must be sufficient to overcome the fluid pressure within injection means 10 and to ensure flow at the required rate as well. In most cases, that requires source 29 to be at a pressure of at least several bars. It is particularly advantageous to supply the inert, bubble forming gas to the fire scene as a liquified gas, either refrigerated as with liquid nitrogen or contained under pressure as with liquid carbon dioxide. The liquified gases may be supplied to injection means 10 as a liquid or as a mixed phase, liquid and gas, and allowed to fully gasify within means 10.

As was set out before, carbon dioxide, either alone or in admixture with nitrogen or other inert gas, is particularly preferred as the foam bubble forming agent. Carbon dioxide may be liquified under pressure and in that state is stored and readily transported in steel cylinders. When a stream of liquid carbon dioxide is merged with water at a pressure much lower than that of the stored liquified gas it both vaporizes and dissolves in the water and cools the water as well. Carbon dioxide is relatively soluble in water under ordinary conditions and is markedly more soluble under pressure. For example, at 15° C. and atmospheric pressure water will dissolve almost exactly its own volume of carbon dioxide. Consequently, feeding liquid carbon dioxide to injector means 10 results in a cooling of the water-foam concentrate stream, the dissolving of a substantial volume of carbon dioxide in the water, and a marked degree of agitation caused by vaporization of the incoming carbon dioxide liquid stream. Further, the cooling effect on the water is transferred to the tank contents and slows the evaporation rate of the flammable liquid. That cooling retards the progress of the fire and tends to prevent the eruptive release of gases and the resulting liquid overflow from the tank that is occasionally experienced in the course of a tank fire. Except for the cooling effect, much the same result is obtained by metering a gaseous stream of carbon dioxide into means 10.

Referring now to FIG. 2, there is shown another embodiment of this invention which offers special advantages in the fighting of fires in large tanks. In this embodiment, tank 12 is sited within a dike 42 which serves to confine the tank contents in the event of an overfill or tank rupture. It is used for the storage of liquid petroleum products 41 and has accumulated a water layer or heel 62 which has separated from the petroleum and settled to the bottom of the tank. Provision is ordinarily made to drain water from the tank by way of an exit conduit 63 having a flow control valve 64 and located adjacent the tank bottom. In this embodiment of the invention, water to make the foam used to extinguish the fire is drawn from the water heel 62 at the bottom of tank 12 and is returned to the tank through entry conduit 66 which is spaced apart from exit conduit 63, is below the surface of the hydrocarbon stored in the tank, and is at a higher elevation than is exit conduit 63.

Floating roof 47 rides atop the surface of the hydrocarbon and will, of course, move up and down as liquid is added to or drawn from the tank. Roof 47 is provided with a circumferential seal 90 which is arranged to make sliding contact with the tank wall as the roof moves up and down. It is now typical, and in many cases required by regulation, that a hydrocarbon storage tank equipped with a floating roof have as well a fixed roof 70 with appropriate vent means 71. The fixed roof is for the purpose of controlling the emission of volatile organic compounds from the tank through the vent means. Vent means 71 may be connected to a vapor collection or recovery system (not shown) arranged to treat gases pushed from the head space 73 above floating roof 47 as the tank is filled. As shown in the drawing, conduit 66 is equipped with a flow control valve 67 and terminates in a flange or other connector means 68. Exit conduit 63 with its flow control valve 64 is connected to one end of a hose or pipe means 71 through flange or connector means 65. The other end of pipe means 71 is attached through connector means 73 to the upstream end of injection means 75 which are generally similar to injection means 10 shown in FIG. 1. The downstream end of injection means 75 is connected through flange 77 to one end of a conduit which may be a pipe or hose section 78. The other end of conduit 78 connects to tank entry conduit 66 through flange 68.

Injection means 75 comprises a conduit with serially arranged entry ports for three separate fluid streams. The first, or upstream, entry port 81 functions to introduce a metered stream of gas or gas forming liquid from source 23 into means 75 in a manner similar to that described in relation to FIG. 1. Likewise, downstream entry port 83 serves for the introduction of a liquid, or powdered solid, foam forming concentrate from source 29 into means 75. There is also provided water entry port 85 which is preferably positioned intermediate foam concentrate entry port 83 and gas entry port 81. Water from an external source 86 may be introduced into the tank through injector means 75 and conduit 78 in the event that the level of water in the water heel 62 is not sufficient to supply the foam making needs of the system. A gas-liquid contacting device 79, which preferably comprises a motionless mixer, may be provided downstream of injection means 75.

Fires in hydrocarbon storage systems such as that one illustrated in FIG. 2 most frequently occur during filling operations. The source of ignition is often a lightening strike or a spark generated by static electricity and the resulting fire usually begins in and around the vent areas and around the periphery of the floating roof 47. As can be appreciated, the structure of the tank makes it very difficult to apply fire extinguishing agents directly to the site of the fire from locations exterior to the tank. The process herein described allows for the delivery of fire extinguishing agents directly to the site of the fire and leaves the extinguished tank in a fire-safe and inerted condition.

The process of this inventive embodiment operates in the following fashion. A flow of inert gas is first established into tank 12 by opening valve 66 while supplying a metered stream of gas from source 23 through entry port 81 and into injector means 75. After gas flow has been established, valve 64 of tank exit 63 is opened to thereby initiate liquid flow, powered by the flowing gas, from the tank bottom through injector means 75 and back into the tank by way of entry conduit 66. Ordinarily, the water level of heel 62 on the tank bottom is sufficiently high to ensure that the liquid flowing from exit 63 is water rather than hydrocarbon. In the event that hydrocarbon rather than water, or a mixture of hydrocarbon and water, flows when valve 63 is opened, then additional water from source 86 is supplied to injector means 75 by way of entry port 85 until an adequate level of water in the tank is obtained.

As has been said before, the energy to cause liquid circulation is provided by the inert gas introduced into injector means 75 through gas source 23. Kinetic energy of the injected gas coupled with its energy of expansion provide an adequate force to circulate water through the system at any desired rate. The energy of expansion is especially significant in those cases in which a liquified gas is introduced into the injector means. As the gas and water stream enters the tank interior at point 91 there is formed an upwelling cone 93 of rapidly expanding gas bubbles. Gas cone 93 forms a relatively low pressure zone for the entry of fluid from conduit 66 into the apex of the cone at point 91. That low pressure zone, in effect, exerts a pull on the fluid entering the tank from conduit 66 and in that way contributes to the forces causing circulation. Thus, the system operates in a fashion similar to that of a gas lift and, like a gas lift, the rising bubbles carry with them droplets of entrained water.

FIG. 2 illustrates injection of the gas and foam constituents into the flammable liquid 41 at a point 91 which is above the level of water layer 62. The process works equally well if the water layer is allowed to rise above the level of point 91 so that injection is made into water rather than hydrocarbon. In contrast, a foam produced by the conventional high back pressure foam-maker is destroyed if it is introduced into a polar liquid such as an alcohol or water.

A metered stream of foam concentrate, either liquid or solid, is added to the circulating water downstream of the gas entry through the foam entry port 83 of injector means 75. As with the embodiment of FIG. 1, the ratio of foam concentrate to water will ordinarily be set such that the foam concentration in the water ranges from about 0.01% to 10% and more preferably in the range of about 0.5% to 6%. Interaction and mixing of the inert gas with the solution of foam concentrate and water causes foam bubbles to form in the mixed phase stream exiting injector means 75. Those bubbles, along with droplets of the foam concentrate-water solution and gas bubbles, are carried upwardly through the liquid column in the cone 93 of expanding gas bubbles to form an expanding foam cap atop the liquid. That foam cap spreads across the liquid surface to form a foam blanket 95 underneath the floating roof 47. Foam is also carried around any imperfections or leaking areas between the tank wall and roof seal 90 to form at least a partial foam cap 97 in the head space atop the roof. The bulk of the foam bubbles and water droplets carried to the surface in the upwelling cone 93 do not contact the liquid contained in the tank during their ascent. That circumstance makes the process indifferent to the type of foam used, any conventional foam will work, and allows injection of the foam stream into either hydrocarbon or water without adverse effect.

The foam blanket 95 atop the stored hydrocarbon will, of course, deteriorate with time and needs continual replenishing until the fire is extinguished and the tank safe. Water and foam solution draining from the foam blanket 95 tends to settle through the hydrocarbon to be collected in the water heel 62. Foam solution draining into the water heel is continuously recirculated by the system and contributes to the production of new foam. Over a period of time, foam concentrate draining into the water heel from the foam blanket 95 builds up in the water heel sufficiently to allow the amount of foam concentrate added to the circulating stream through injection means 75 to be reduced or even eliminated. Thus, there is obtained a much more efficient use of foam concentrate than can be realized in present practice. Even more importantly, this process allows the continuous application of foam to the interior of a burning storage tank for extended periods of time with no significant danger of overflowing the tank.

As has been set out before, the preferred inert gas for use in this process is carbon dioxide with nitrogen a second choice. The inert gas performs a number of separate and distinct process functions. Its kinetic energy and energy of expansion provide the motive force to cause circulation of water from the tank bottom, through the injector means, and back to the tank. In contrast, conventional subsurface foam injection using a high back pressure foam-maker is powered by a large volume, high velocity, high pressure stream of water. Expanding bubbles of the inert gas provide transport of foam bubbles and liquid droplets upwardly through a column of fluid, either water or liquid hydrocarbons, to the surface thereof without any significant degree of interaction between the fluid and the foam bubbles and droplets. A substantial degree of fire extinguishment is provided as well by the delivery of the inert gas from the upwelling foam column to the surface of the burning hydrocarbon.

Inert gas must be supplied to the system at a rate, relative to the water flow, sufficient to accomplish all of the process needs. Generally speaking, a desirable rate of inert gas introduction relative to water flow so as to rapidly produce a foam blanket and swiftly extinguish a fire is at least 10 volumes of gas per volume of water measured at standard conditions. Lesser rates of gas introduction can, of course, be used at the expense of extinguishment efficiency. It is also preferred, especially with the embodiment of FIG. 2, to introduce the inert gas into injector means 75 as a liquid. When using liquid carbon dioxide as the inert gas, preferred introduction rates range from about 2 to about 10 volumes of liquid carbon dioxide per 100 volumes of water-foam concentrate solution. Even higher rates of liquid carbon dioxide injection can be used with advantage, particularly at the early stages of the extinguishment effort. When liquid carbon dioxide is injected into a water stream at high rates, a portion of the liquid carbon dioxide turns to solid flakes or particulates of dry ice. Those particulates are carried along with the foam bubbles into the upwelling bubble cone 93 to effectively release large amounts of carbon dioxide gas directly into the fire zone. With liquid nitrogen, preferred introduction rates range from about 1 to about 5 volumes of liquid nitrogen per 100 volumes of the circulating water-foam solution.

As can be readily appreciated, a substantial advantage provided by the fire extinguishment process embodied in FIG. 2 as compared to conventional extinguishment techniques is that operation of the process results in no net gain to the liquid contents of the tank. Provided that the water heel 62 at the bottom of the tank is sufficient to supply the circulating needs of the system, the volume of liquid in the tank remains essentially constant. Consequently, the danger of overflowing the tank and spreading the fire on the ground around the tank base is essentially eliminated.

Yet another effect contributes to the fire extinguishing capabilities of this process. The fire itself feeds upon gases vaporized from the liquid. The rate of vaporization, in turn, depends upon the temperature of the surface liquid and upon the thermal radiation striking that surface. As foam is injected into the hydrocarbon contained in tank 12 the rising column of foam bubbles causes a circulating flow of liquid from the lower portions of tank 12 toward the surface. The liquid contained in the lower portion of the tank is, at least in the early stages of a fire, considerably cooler than is the surface liquid. Circulation of the cooler bottom liquid thus decreases the vaporization rate and effectively decreases the amount of fuel fed to the fire.

The process of this invention can successfully be practiced using commercially available foam concentrates which may be either the synthetic or protein-based type. Synthetic foams useful in the process include the aqueous film forming foams commonly referred to as AFFF and particularly alcohol-resistant AFFF foam concentrates. It is particularly preferred, however, to employ applicant's own synthetic poly viscous foams which are described and claimed in his U.S. Pat. No. 5,053,147 and in his pending U.S. patent application Ser. No. 07/871,070.

Further, the process may also find use in the prevention of fires in addition to their extinguishment. The gas injection procedure taught by the process may also be used to create and maintain an inert atmosphere in the void space above the liquid surface in hydrocarbon storage tanks during filling, emptying and transfer operations. In shipboard operations, the process can serve as a backup to existing inerting systems.

As may now be more fully appreciated, the methods and apparatus of this invention allow a far more effective use of fire extinguishing foams than do the techniques of the prior art. None of the apparatus employed is directly exposed to the fire as is the case with most fixed or semifixed extinguishing systems. The foam itself is totally protected from flame and thermal radiation until it erupts upon the burning surface. In contrast, many ordinary techniques of foam application to tank fires subject the foam jet to intense thermal radiation as it passes through the flames and impinges upon the surface of the burning liquid. The use of an inert gas, particularly carbon dioxide, to fill the foam bubbles also enhances the foam survival as the atmosphere within and about the foam layer forming atop the liquid surface does not support combustion. A foam bridge head is quickly formed on the surface of the burning liquid and that bridge head is continually resupplied with foam allowing it to rapidly spread across the entire surface of the liquid to totally extinguish the flame and to prevent its reignition and burn-back.

I claim:

1. A method for extinguishing a fire burning in a tank containing a flammable liquid comprising:

establishing a water layer at the bottom of the tank below said flammable liquid;

establishing a flow of inert gas into said tank at a first location that is below the surface of said flammable liquid;

removing a stream of water from said water layer at a second location adjacent the tank bottom, said first and second locations spaced apart one from the other, said first location being at a higher elevation than is said second location;

merging said flowing gas and said water stream and circulating the combined stream back to the tank at said first location, said circulation powered by the energy of said flowing gas;

adding a foam concentrate to said circulating gas and water stream while maintaining the flow of inert gas at a rate sufficient to power the circulation of said water stream, to form foam bubbles by interaction with said foam concentrate and water, and to lift liquid droplets and foam bubbles up through the flammable liquid to the surface thereby forming a fire extinguishing foam layer that spreads across the surface of the flammable liquid.

2. The method of claim 1 wherein said inert gas is selected from the group consisting of carbon dioxide, nitrogen and mixtures thereof.

3. The method of claim 2 wherein said inert gas comprises carbon dioxide and wherein the carbon dioxide is injected as a liquid into the circulating water stream.

4. The method of claim 3 wherein the amount of liquid carbon dioxide injected into the circulating water stream ranges from about 2 to 10 volumes of liquid carbon dioxide per 100 volumes of water,

5. The method of claim 2 wherein said inert gas comprises nitrogen and wherein the nitrogen is injected as a liquid into the circulating water stream,

6. The method of claim 5 wherein the amount of liquid nitrogen injected into the circulating water stream ranges from about 1 to 5 volumes of nitrogen per 100 volumes of water.

7. The method of claim 1 wherein said foam concentrate is added to the circulating water stream in an amount sufficient to provide a foam concentration in the water ranging from 0.01% to 10%.

8. The method of claim 1 wherein the volume of liquid within said tank remains essentially constant during the circulation of said combined stream.

9. The method of claim 1 wherein said first location is above the interface of said bottom water layer and said flammable liquid.

10. The method of claim 1 wherein said first location is below the interface of said bottom water layer and said flammable liquid.

11. The method of claim 1 wherein said flammable liquid comprises hydrocarbons and wherein said water layer comprises water which has separated and settled from said hydrocarbons.

* * * * *